US007000668B2

(12) United States Patent
Sears et al.

(10) Patent No.: US 7,000,668 B2
(45) Date of Patent: Feb. 21, 2006

(54) SYSTEM AND METHOD FOR SEALING OPENINGS IN RESPONSE TO SMOKE, NOXIOUS FUMES, OR CONTAMINATED AIR USING A ROLL-DOWN BARRIER

(75) Inventors: John J. Sears, Meridian, ID (US); Tasche L. Strieb, Boise, ID (US); Eric Holstine, Boise, ID (US); Kevin Klocek, New York, NY (US); Thomas A. Allen, Boise, ID (US)

(73) Assignee: Smoke Guard Corporation, Boise, ID (US)

( * ) Notice: Subject to any disclaimer, the term of this patent is extended or adjusted under 35 U.S.C. 154(b) by 25 days.

(21) Appl. No.: 10/172,685

(22) Filed: Jun. 13, 2002

(65) Prior Publication Data

US 2003/0051829 A1 Mar. 20, 2003

Related U.S. Application Data

(60) Provisional application No. 60/315,303, filed on Aug. 27, 2001.

(51) Int. Cl.
*E05F 15/20* (2006.01)

(52) U.S. Cl. ..... 160/7; 160/2; 160/9

(58) Field of Classification Search ..... 160/1, 160/7, 9, 2

See application file for complete search history.

(56) References Cited

U.S. PATENT DOCUMENTS 862,644 A 8/1907 Kepler 2,564,208 A 8/1951 Michelman (Continued)

FOREIGN PATENT DOCUMENTS

| | | |
|---|---|---|
| CH | 560833 | 4/1974 |
| DE | 19718238 A1 | 11/1998 |
| EP | 1249255 | 10/2002 |
| FR | 2 617 230 | 6/1990 |
| GB | 2 060 744 | 5/1981 |
| GB | 2 108 839 | 5/1983 |
| GB | 2202890 | 10/1988 |
| WO | WO 97/43011 | 11/1997 |

*Primary Examiner*—Blair M. Johnson
(74) *Attorney, Agent, or Firm*—Perkins Coie LLP

(57) ABSTRACT

A system and method for rapidly and reliably sealing off a selected opening from the passage of smoke, noxious fumes, or contaminated air includes a powered clutch and viscous governor that provides a fail-safe mode of operation. A curtain is positioned in a housing adjacent to an upper limit of an opening such as a hoist access-way. The curtain is wrapped around a spindle that is connected to a spool via two cords. The curtain is held in the housing in a stored configuration by a powered clutch so that upon removal of power, either via a controller or by power loss, the clutch releases the spool allowing the cord to unwind lowering and thus deploying the curtain. A capacitor can be included to prevent inadvertent deployments due to momentary power loss. The speed at which the spool rotates, and correspondingly the curtain deploys, is limited by a viscous governor coupled to the spool. The curtain includes flexible magnets that attach to ferrous side rails forming a nearly air tight seal preventing the passage of smoke, noxious fumes or contaminated air through the opening.

14 Claims, 6 Drawing Sheets

U.S. PATENT DOCUMENTS

| | | | | | |
|---|---|---|---|---|---|
| 2,582,276 | A | | 9/1952 | Powers | |
| 3,006,352 | A | | 10/1961 | Hozak | |
| 3,016,952 | A | | 1/1962 | Shero | |
| 3,306,345 | A | | 2/1967 | Youngs | |
| 3,398,779 | A | | 8/1968 | Kuss | |
| 3,687,185 | A | | 8/1972 | Singer | |
| 3,766,958 | A | | 10/1973 | Mitchell | |
| 3,807,480 | A | | 4/1974 | Smart | |
| 3,877,525 | A | | 4/1975 | Husson et al. | |
| 3,955,330 | A | | 5/1976 | Wendt | |
| 3,960,216 | A | | 6/1976 | Isobe | |
| 3,964,214 | A | | 6/1976 | Wendt | |
| 4,077,474 | A | | 3/1978 | Hattori | |
| 4,079,772 | A | | 3/1978 | Klaenhammer et al. | |
| 4,398,371 | A | | 8/1983 | Jenkins | |
| 4,802,523 | A | | 2/1989 | Scholten et al. | |
| 5,195,594 | A | | 3/1993 | Allen et al. | |
| 5,383,510 | A | | 1/1995 | Allen | |
| 5,482,103 | A | * | 1/1996 | Burgess et al. | 160/9 |
| 5,607,758 | A | | 3/1997 | Schwartz | |
| 5,836,424 | A | | 11/1998 | Allen | |
| 5,862,851 | A | | 1/1999 | Stoebich | |
| 5,896,907 | A | * | 4/1999 | Dever et al. | 160/6 |
| 6,070,640 | A | | 6/2000 | Miyagawa | |
| 6,138,739 | A | | 10/2000 | Crider | |
| 6,357,507 | B1 | | 3/2002 | Stoebich et al. | |
| 2003/0051829 | A1 | | 3/2003 | Sears | |

* cited by examiner

SYSTEM AND METHOD FOR SEALING OPENINGS IN RESPONSE TO SMOKE, NOXIOUS FUMES, OR CONTAMINATED AIR USING A ROLL-DOWN BARRIER

CROSS-REFERENCE TO RELATED APPLICATION(S)

This application claims the benefit of U.S. Provisional Patent Application No. 60/315,303, filed Aug. 27, 2001.

TECHNICAL FIELD

The following disclosure relates generally to smoke barrier systems and more particularly to roll down smoke/gas barrier systems.

BACKGROUND

Smoke and noxious gasses can be very dangerous to occupants during a building fire. As is well known, many fire-related deaths are the result of smoke inhalation. During a fire, or an event where dangerous gases may be present, fumes are likely to travel very quickly through paths that offer little resistance. Paths such as elevator shafts are often well drafted and provide an excellent avenue by which smoke and other dangerous gases can rapidly travel to otherwise unaffected areas of a building. To prevent such a migration of dangerous gases, many devices and assemblies have been designed to limit the dispersal of such fumes by cutting off possible paths or openings. Examples of such devices are smoke screen assemblies disclosed in U.S. Pat. No. 5,383,510, issued Jan. 24, 1995, and U.S. Pat. No. 5,195,594, issued on Mar. 23, 1993, both of which are incorporated herein by reference in their entirety.

Barriers of the types described in the aforementioned patents are often electro-mechanically operated so that a screen is placed in front of an opening upon the detection of smoke, a noxious gas, or dangerous fumes. In normal conditions, power is provided to the barrier system from a main power supply for the deployment of the barrier. In situations that are accompanied by power loss, the barrier system must switch to a back up power supply, such as a battery system or other alternative power source, for deployment of the barrier. The back up power supply adds to the cost and complexity of the barrier system.

BRIEF DESCRIPTION OF THE DRAWINGS

In the drawings, the same reference numbers identify identical or substantially similar elements or acts. The headings provided herein are for convenience only and do not necessarily affect the scope or meaning of the claimed invention.

DETAILED DESCRIPTION

Apparatus and corresponding method for sealing various openings in response to smoke, noxious fumes, or contaminated air using a roll-down barrier in accordance with embodiments of the present invention are described in detail herein. In the following description, numerous specific details are provided, such as specific descriptions of mechanical and electro-mechanical components, specific methods for deploying and retrieving a flexible barrier, composition of the barrier, etc. to provide a thorough understanding of, and enabling description for, embodiments of the invention. One skilled in the relevant art, however, will recognize that the invention can be practiced without one or more of the specific details, or with other components, methods, etc. In other instances, well known structures or operations are not shown, or are not described in detail, to avoid obscuring aspects of the invention.

Figure 1:
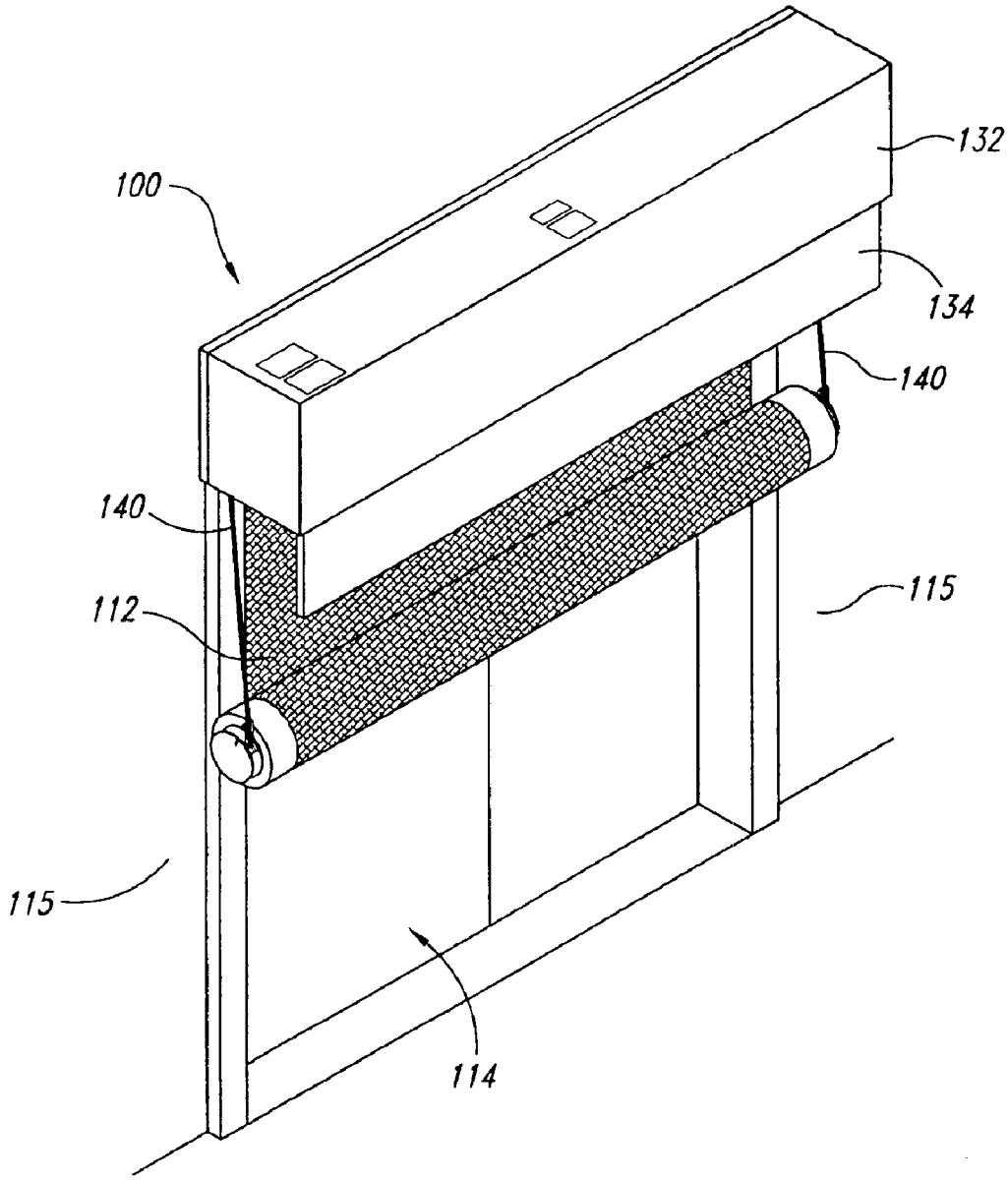
FIG. 1 is an isometric view of a barrier assembly for sealing off an opening in accordance with one embodiment of the present invention, shown in a partially deployed position.

FIG. 1 shows an isometric view of one embodiment of a barrier assembly 100 that can rapidly deploy a flexible curtain 112 to seal off an opening 114 in a wall 115. The curtain 112 can be deployed, for example, upon detection of smoke, noxious fumes, or contaminated air. The curtain 112 is illustrated in FIG. 1 in a partially deployed position. In the illustrated embodiment, the opening 114 is an elevator doorway formed in the wall 115 of a building or other similar structure. The barrier assembly 100 includes a housing 132 mounted to the wall 115 directly above and centered on the opening 114. The housing 132 releasably contains the flexible curtain 112 in a rolled-up, stored position until the curtain is deployed to a sealing position. The housing 132 also includes a hinged bottom flap or door 134 that encloses the flexible curtain 112 in the stored position when the door is closed. When the door 134 is open, the flexible curtain 112 can unroll to the sealing position and fully seal the opening 114 to prevent smoke, noxious gases, or contaminated air from passing through the opening in either direction.

Figure 2:
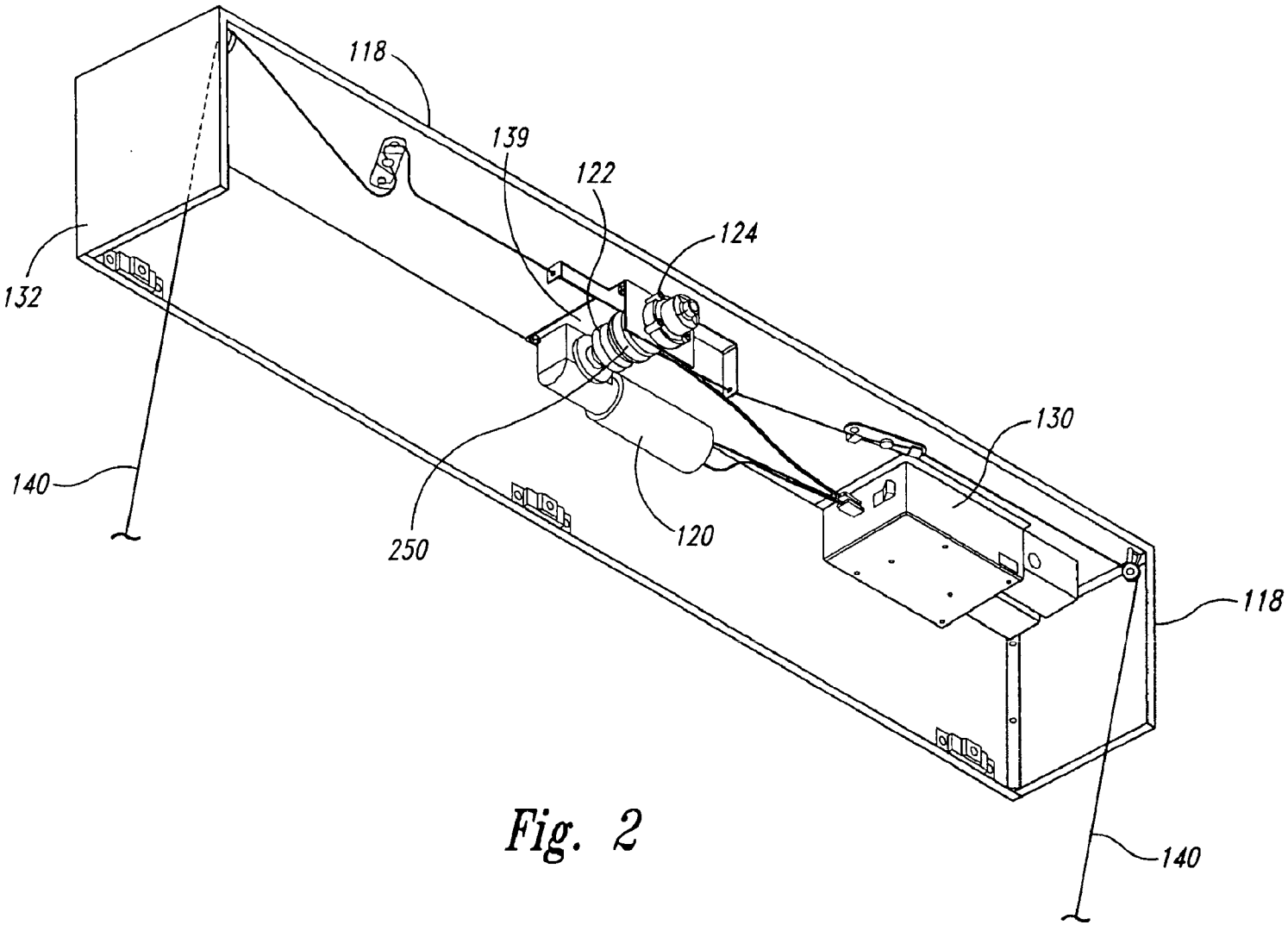
FIG. 2 is an enlarged partial isometric view of one embodiment of a housing assembly of the barrier assembly of FIG. 1 with the door not shown for purposes of clarity.

FIG. 2 is an enlarged partial isometric view of the barrier assembly's housing 132 with the door of the housing not shown for purposes of clarity. The housing 132 is shown, viewed from below, in an orientation with the wall mounting surface 118 exposed and positioned as it would be mounted on a wall. The housing 132 can contain a motor, a spool 250, a coupler 122, a controller 130, and a viscous governor 124 or dashpot (discussed in greater detail below) that controls the descent of the barrier assembly 100. In one embodiment, the controller 130 is coupled to a smoke or gas detector (not shown) that provides a signal to the controller when smoke or the like is detected, at which time the door 134 opens and the curtain 112 is deployed.

Figure 3:
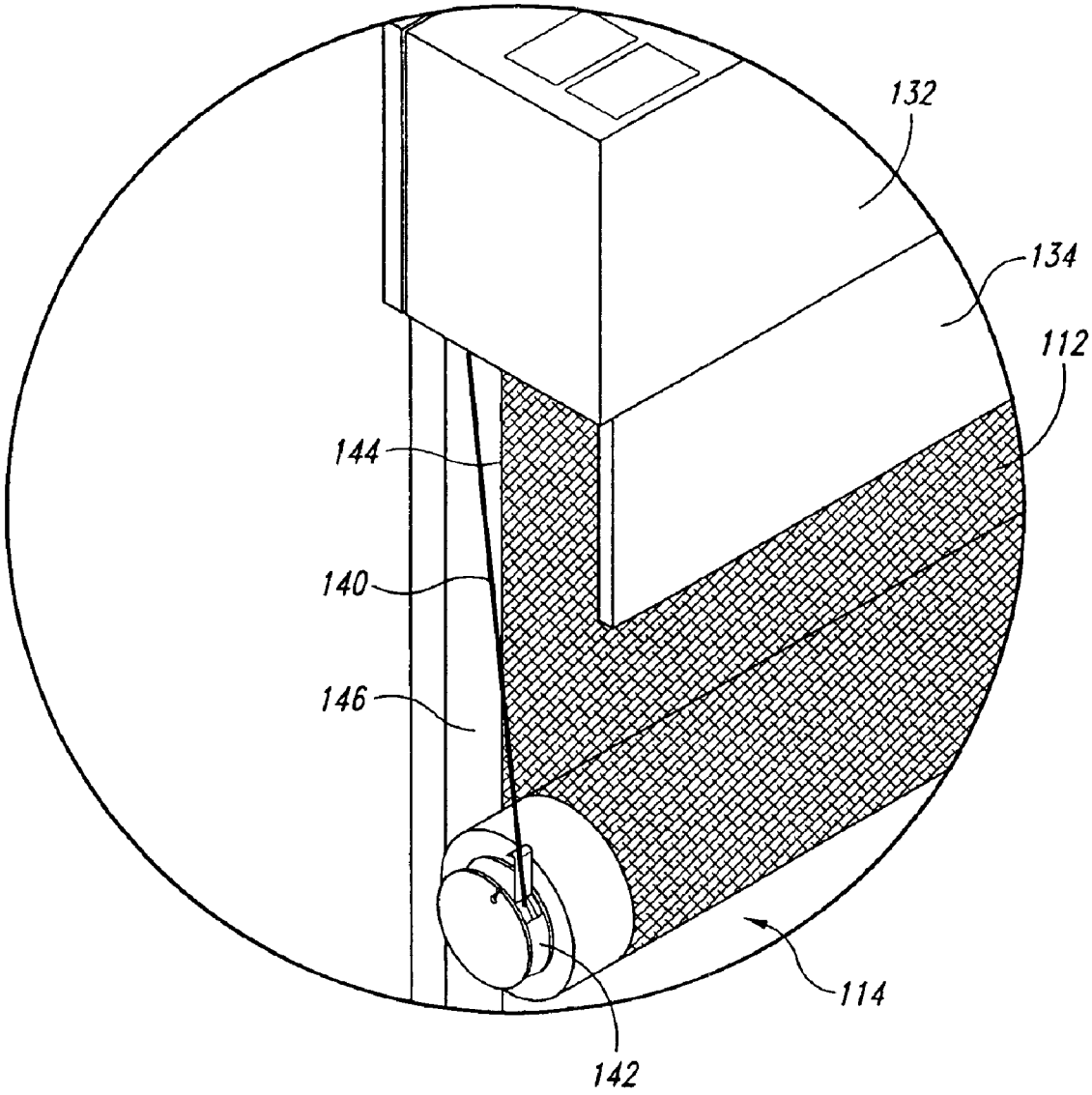
FIG. 3 is a partial isometric view with one embodiment of the barrier assembly of FIG. 1 in a partially deployed position.

FIG. 3 is an enlarged, partial isometric view of the barrier assembly's housing 132 and flexible curtain 112 in a partially deployed position after the door 134 has been opened. The curtain 112 is stored in the housing 132 wrapped around a spindle 142. The curtain can be attached to the spindle 142. A connecting cord 140 is attached to a pulley at each end of the spindle 142 that allows the spindle 142 to rotate, thus deploying the curtain 112 in front of and centered on the opening 114. Accordingly, as the spindle 142 moves in a downward motion to a lowered position the curtain 112 unwraps from the spindle 142. The same motion acts to wind the connecting cord 140 around each pulley on the end of the spindle 142. Attached to each edge of the curtain 112 are flexible magnets 144. The flexible magnets 144 are aligned with Ferrous side rails 146 or the Ferrous hoistway frame located at each side of the opening 114 50 that upon deployment of the curtain 112, the flexible magnets 144 are magnetically attracted to the Ferrous side rails 146 forming a substantially airtight seal. The spindle contains an unattached tube within the rolled screen material that floats around the shaft of the spindle. This unattached tube rests against the floor at the bottom of the descent due to gravity, and forms the bottom seal. The seal at the top is maintained by sealing the top edge of the screen material to the housing with a silicone material. Thus the top is sealed by the silicone material, the sides by the flexible magnets adhering to the Ferrous rails or elevator frame, and the bottom by the weighted tube contained within the screen roll pushing the screen material against the floor.

Figure 4:
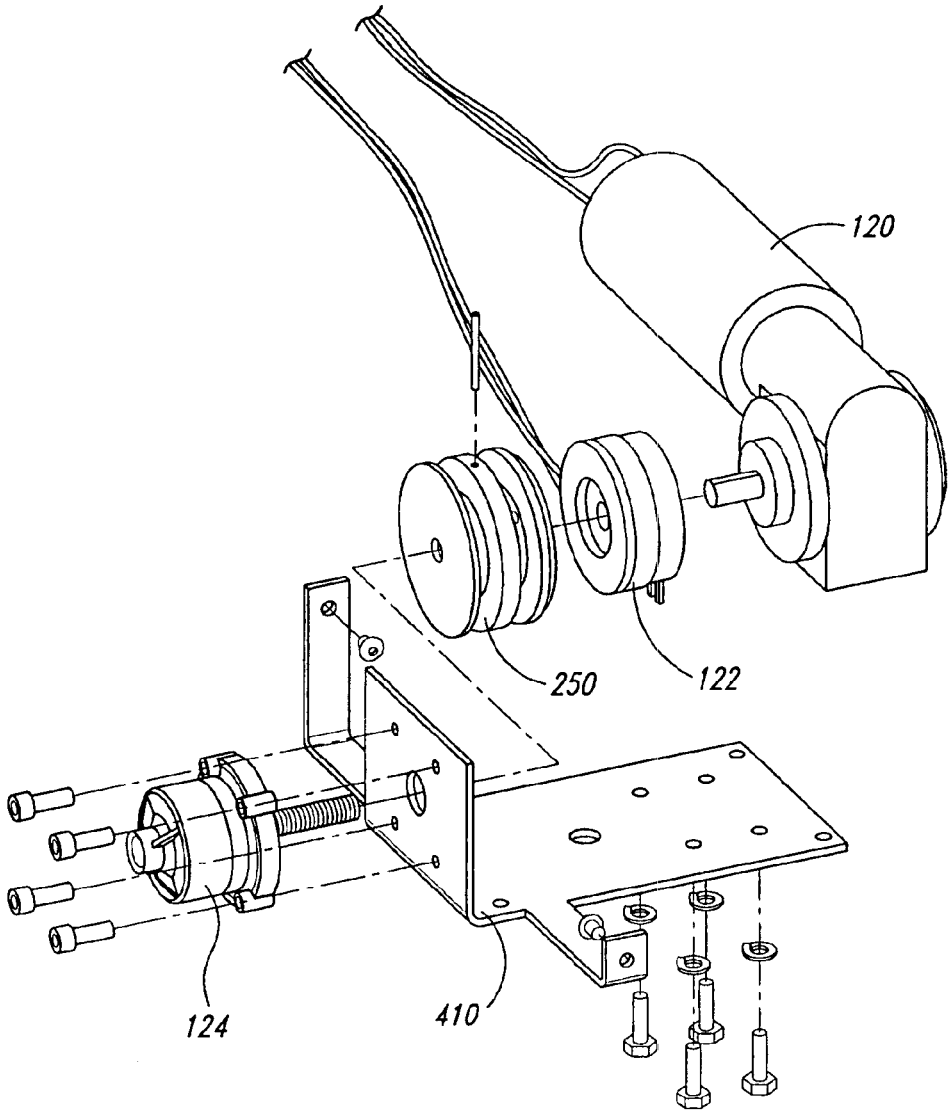
FIG. 4 is an enlarged, exploded isometric view of a motor, clutch, viscous governor and spool of the barrier assembly with one embodiment of FIG. 1.

In the stored configuration, the curtain 112 is wrapped around the spindle 142 and raised into the housing 132 by the two respective connecting cords 140. The connecting cords 140 are wound around the spool 250 coupled to the motor 120 via the coupler 122, as shown in FIG. 4. Once raised inside the housing 132, the curtain 112 and spindle 142 combination is enclosed by closing the door 134 of the housing 132. The door 134 can be held in place by a magnet, latch or other similar fastening device. Upon deployment of the curtain 112 and downward motion of the spindle 142, the curtain/spindle combination contacts the door 134 and the door opens such that the deployment is not impeded.

The curtain 112, in one embodiment, is essentially comprised of 1 mil thick polyamide film reinforced with 100 denier nomex yarn spaced with a ¼ inch matrix. The reinforcing fill yarn is attached to the film and overlaps the reinforcing warp yarn that is not adhered to the film. The bond between the yarn and the film is at least 1 pound per square inch. In another embodiment, the screen material is a fiberglass fabric, which may be reinforced with stainless steel thread and is covered with a polymer coating to provide a higher temperature resistance. This alternate material is connected to the flexible magnets in the same manner as the polymide film. The film is connected along its length to a 2½ inch wide by 0.125 inch thick multi-pole magnet of energized ferrite in a nitrile rubber binder exerting a minimum 1.4 MGOe of force. The multi-poles are orientated along the length and perpendicular to the magnet's width. The film and magnets are aligned relative to each other's neutral axes and connected with a 0.5 inch wide by 0.125 inch thick continuous joint of low-modulus silicone.

FIG. 4 is an enlarged, exploded isometric view of a motor, coupler, viscous governor or dashpot, and spool of the barrier assembly of FIG. 2. The coupler 122 and viscous governor 124 control the release of the curtain 112 from the housing 132 and the rate of the curtain's deployment, respectively. These functions are determined and initiated by the controller 130 located in the housing 132. The viscous governor 124 is coupled directly to the spool 250, which is in turn coupled to the motor 120 via the coupler 122. This entire assembly is mounted to the housing 132 via a mounting bracket 139. In the illustrated embodiment, the coupler 122 is a powered clutch that releasably engages the spool 250 to the motor 120. Other embodiments can use similar devices as the viscous governor to control rotation of the spool 250.

One end of each respective cord 140 holding the spindle 142 is attached to the spool 250, such that the cord can be wound onto the spool when the spool is turned by the motor 120. The motor 120 and the coupler 122 are operatively connected to a controller 130 so as to power and control activation of the motor in positive engagement of the coupler 122 with the motor 120. The motor 120 is unidirectional. The motor 120, upon receiving power from the controller 130, winds up the cord 140 attached to the spindle 142 by turning the spool 250. The spool 250 is coupled in one embodiment to an electro-mechanical clutch that, with the power supplied by the controller 130, mechanically couples the spool 250 to the motor 120. As the motor 120 is unidirectional, the absence of power to the motor 120, with the electro-mechanical clutch engaged, serves to hold the spool 250 in a fixed non-rotational position thus holding the curtain 112 in the stored position in the housing. The coupler 122 in this embodiment is electro-mechanical but can be electric, mechanical or of a similar design that can achieve the same functionally.

Figure 5:
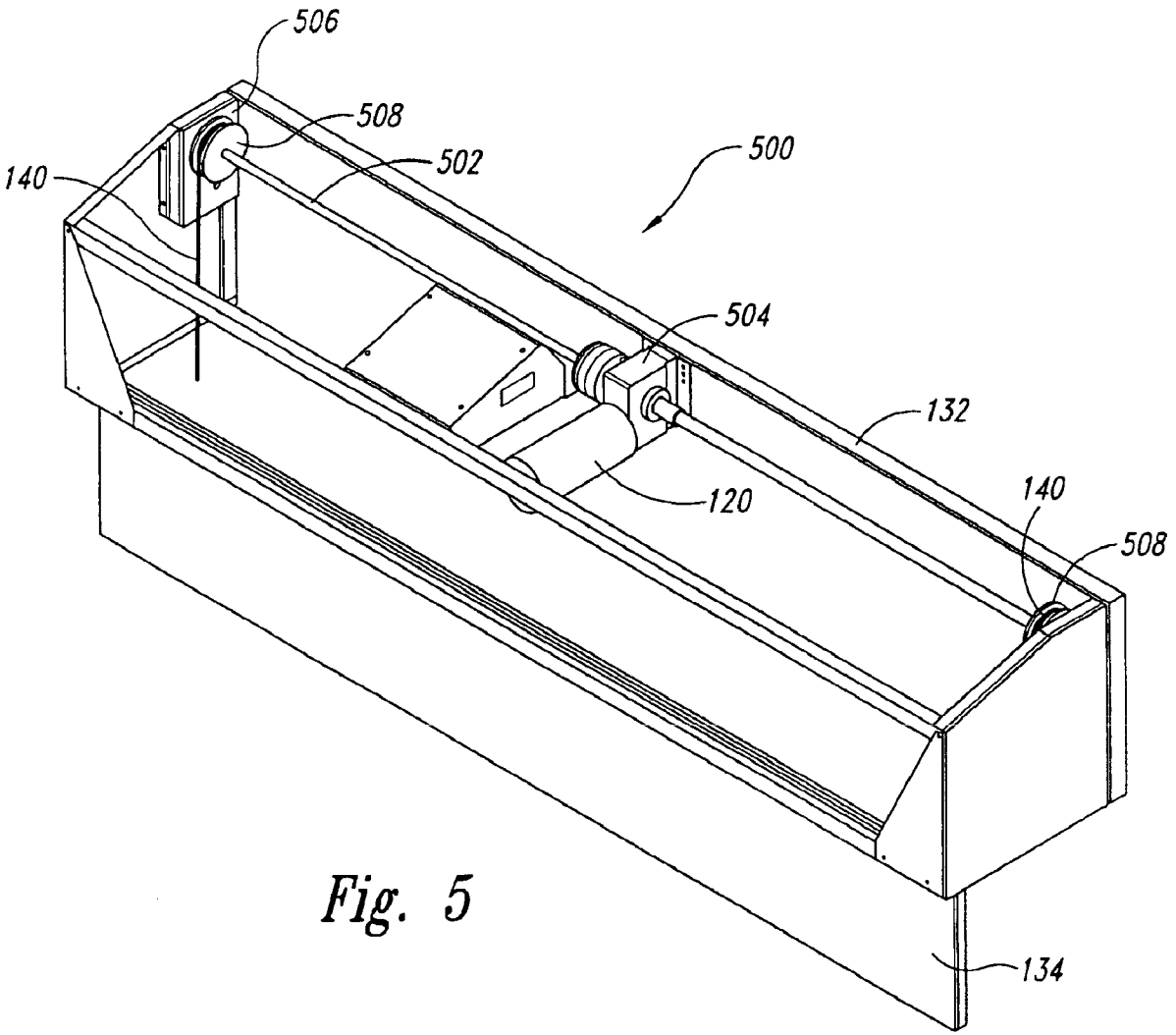
FIG. 5 is a partial isometric view of a barrier assembly in accordance with an alternate embodiment of the invention, with sidewalls of the housing and the curtain not shown for illustrated purposes.

FIG. 5 is a partially isometric view of a barrier assembly 500 in accordance with an alternate embodiment of present invention. The side walls of the housing (shown as 132 in FIG. 3) are not shown in order to show the components within the housing. This alternate embodiment is similar to the embodiment illustrated in FIG. 4, except as discussed below. In this alternate embodiment, the motor 120 is coupled to a rigid drive shaft 502 via a clutch 504 mounted to the housing 132. One end of the drive shaft 502 is rotatably connected to the viscous governor mounted to the housing 132. In this embodiment, the cables 140 controlling the curtain 112 (not shown) are attached to two pulleys 508 mounted directly to the end portions of the rigid drive shaft 502. Accordingly, each end of the respective cord 140 is attached to a respective pulley 508, such that rotation of the drive shaft 502 will wind or unwind the cord.

In this alternate embodiment, the motor 120 is operatively connected to the controllers and the coupler 504 so as to control rotation of the drive shaft 502. The motor 120, upon receiving power from the controller 130 winds up the cords 140 into the pulleys 508 by turning the drive shaft 502. The motor 120 is a unidirectional motor similar to the motor discussed in the above embodiments. In the presence of power to the coupler 504, the coupler 504, such as an electro-mechanical clutch, will engage the drive shaft 502 so as to hold the drive shaft in a fixed, non-rotational position, thus holding the curtain 112 (not shown) in the stored position in the housing 132. With the drive shaft 502 prevented from rotating, the curtain 112 (not shown) remains in the stored configuration. When power to the coupler 504 is interrupted, the coupler is disengaged so the drive shaft 502 can rotate as the curtain unrolls to the deployed position.

In this alternate embodiment, after the curtain 112 has been deployed and then rolled back up into the stored position in the housing, the door 134 of the housing opens when the curtain 112 (not shown) is released and unwinds to the deployed position. When the curtain is rolled back up into the stored position, the door 134 can be automatically reset to the closed position by a door closure mechanism. The door 134 remains closed until the curtain 112 is deployed again.

The coupler 122 is coupled to a power supply and is configured to positively engage the motor 120 with the spool 250 holding the spool stationary while power is applied to the coupler 122. With the spool 250 prevented from rotating, the spindle 142 or the drive shaft in another embodiment containing the curtain 112 remains in the stored configuration. The controller 130 is configured so that, when a signal is received from the smoke detector or similar sensor that smoke or other gases have been detected, the power to the electro-mechanical coupler 122 is interrupted, disengaging the coupler 122, releasing the spool 250 from the motor 120. The controller 130, or the weight of the falling spindle 142, simultaneously opens the door. With removal of power from the coupler 122 and the spool 250 released, the cords 140 unwind and the curtain 112 unrolls toward the deployed sealing position. The de-energized coupler 122 allows the spool 250 to freely turn, although the spool remains coupled to the viscous governor 124.

The viscous governor 124 limits the rotation rate of the spool 250 by using the natural friction of a displaced fluid in a combined space. As a coupler 122 releases the spool 250 from the motor 120, the weight of the spindle 142 and the curtain 112 causes the spool 250 to rotate. As the spool 250 rotates, the cord 140 unwinds from the spool, lowering the curtain 112. As the rotation of the spool 250 increases, the dynamic pressure of the displaced fluid within the viscous governor 124 mounts until the force accelerating the rate of rotation of the spool is equally opposed by the dynamic pressure of the displaced fluid within the viscous governor. Once equilibrium of forces has been achieved, the rotation rate of the spool 250 peaks and then decreases until the curtain reaches the deployed, sealing position. The viscous governor 124 limits the rate at which the spool 250 rotates, thus controlling the rate at which the spindle 142 is lowered and the curtain 112 is deployed.

In one embodiment the viscous governor 124 can include a sealed compartment containing a viscous fluid such as oil or the like. The viscous fluid is displaced within the sealed compartment by a paddle or wheel coupled to a shaft extending from the compartment. As the shaft and corresponding wheel are rotated, the fluid in the compartment must be displaced. The resistance to the turning of the wheel or corresponding shaft is directly proportional to the dynamic pressure developed by the fluid's motion. Since the dynamic pressure of a fluid varies according to the velocity of the fluid raised to the second power, the resistance felt by the shaft increases exponentially as the speed of the shaft's rotation increases.

The viscous governor 124 prevents a free fall descent of the spindle 142, so as to deploy the curtain 112 in a controlled manner and to provide proper alignment of the flexible magnets 144 with the ferrous side rails 146. It should be noted that the motor 120 in this embodiment is not used or involved in controlling the deployment of the curtain 112 nor does it act to brake the descent of the curtain. The motor 120 is used solely to raise the curtain 112 and spindle 142 to the stored position. Once in the stored position, the coupler 122 and a gearbox holds the curtain 112 and spindle 142 in the stored position.

As indicated, once the controller 130 removes power from the coupler 122, the deployment of the curtain 112 occurs without the need of additional power, thereby providing a fail-safe configuration of the barrier assembly 100. In event of inadvertent power loss to the barrier assembly 100 and initiation of curtain deployment by the controller 130, the power loss to the coupler 122 acts to release the spool, deploy the curtain 112, and seal the opening 114 as if it was initiated by the controller 130. In this manner the barrier assembly 100 includes an inherent fail-safe capability. In other words, when power to the barrier assembly 100 fails, the assembly fails to a safe condition, wherein the curtain 112 unrolls and covers the opening 114.

Inadvertent deployment of the curtain 112 due to momentary power failures can be prevented in an alternative embodiment by including a capacitor or other temporary power supply connected to the coupler 122 that provides a suitable time delay until deployment. The capacitor can provide a source of emergency power for a finite period of time preventing the coupler 122 from disengaging the spool 250 from the motor 120 should the primary power source fail. In one case, the capacitor is configured to prevent the deployment of the curtain 112 for up to approximately 10 seconds in situations of complete power loss of the primary power source. After 10 seconds has elapsed and the power in the capacitor has discharged, the coupler 122 releases the spool 250 from the motor 120 and the curtain 112 deploys. Other capacitors of varying capacitance can be used to adjust the time delay to meet operational constraints.

After the curtain 112 has been deployed to cover the opening 114 and power is available to the barrier assembly 100, the controller 130 can activate the coupler 122 to engage the motor 120 to the spool 250, rewinding the cords 140 onto the spool 250 and raising the curtain 112 back into the housing 132. The rate of rotation of the spool 250 by the motor 120 is sufficiently low, such that the motor 120 easily overcomes the friction introduced by the viscous governor 124. As the spindle 142 is raised it rotates, winding the curtain 112 around the spindle 142 and the cord 140 on to the spool 250. Once the curtain 112 reaches the top of the opening, the curtain uncovers an up-limit switch, allowing a switch to become open, signaling that an upper limit has been reached. Power is removed from the motor 120 yet maintained to the coupler 122 to hold the curtain 112 in the raised, stored position. In the stored position, the door 134 can be manually or automatically shut to hide the curtain 112 from view.

The method of deployment of the curtain 112 in at least one embodiment can be summarized as follows. With the curtain 112 in the stored position, and upon detection of noxious fumes, smoke, or contaminated air adjacent to the opening 114, the controller 130 opens a switch disconnecting power to the coupler 122. With power removed from the coupler 122, the coupler disengages the spool 250 from the motor 120, thereby releasing the spool 250 to rotate. As the spool 250 rotates under the weight of the spindle 142 and the curtain 112, the curtain unrolls and the spindle moves downwardly toward the deployed, sealing position. The door 134 of the housing 132 opens and swings away allowing the curtain 112 to unroll over the opening 114. As the spindle 142 descends, the viscous governor 124 slows and controls the curtain's rate of descent. The curtain 112 unwinds from the spindle 142 with the flexible magnets 144 in alignment with and engaging the ferrous side rails 146. The flexible magnets 144 attach to the ferrous side rails 146 forming a nearly air tight seal around the opening 114. Simultaneously to the unrolling of the curtain 112, the cords 140 wind up on the pulleys located at each end of the spindle 142.

When the reinforced curtain 112 reaches the floor, a lower limit of the opening 114, or an established extension limit, the tube around the shaft of the spindle engages the floor forming a seal. As the curtain 112 expands under pressure, the interface between the curtain 112 and the flexible magnetic edge strips 144 stretches a predetermined amount to limit the amount of expansion.

As described herein, the curtain 112 can be returned to its original position in the housing by engaging the spool 250 to the motor 120 via the coupler 122 and rewinding the cord 140 around the spool 250. The cord 140 winding around the spool 250 causes the cord 140 to unwind from the pulley at each end of the spindle 142. The unwinding of the pulleys causes the spindle 142 to rotate, winding up the curtain 112 as the curtain 112 moves from the deployed, sealing position to the upper, stored position. As the curtain 112 retracts and wraps around the spindle 142, it uncovers an up-limit switch that cuts off power to the motor 120 approximately 70–80 ms later. The delay in shutting off the motor 120 ensures the curtain goes well past the up-limit switch and does not trigger the motor to reengage due to oscillations. As the curtain 112 is retracted into the housing, the coupler 122 maintains the spool 250 motor 120 engagement to prevent the curtain's unintentional redeployment. While the motor 120 is switched off after curtain retraction, power remains applied to the coupler 122 keeping the motor 120 engaged with the spool 250 holding the curtain 112 in the stored position.

The controller 130 in one embodiment can be set with a retract cycle for approximately 20 seconds or another selected length of time appropriate for the size of the curtain 112 to avoid excess strain on the motor 120 or the controller 130. This allows the motor 120 to shut off if the up-limit switch has not triggered in the selected amount of time. In such conditions the controller 130 can be set to remove power from the coupler 122 in conjunction with a "motor shut-off" command to deploy the curtain 112. This can provide a visible indication of a need to re-set the barrier assembly 100.

In an alternative embodiment, the controller 130 can include an automatic retract feature. The automatic retract feature commands the curtain 112 to retract upon the initial application of power. The curtain 112 retracts and then, as the up-limit switch is triggered, the motor 120 cuts off. If the detector signals to the controller that smoke, noxious fumes or contaminated air is still present, the auto-retract feature can be disabled keeping the curtain 112 in the deployed position. Once the detectors fail to detect the triggering condition, the automatic retract feature will retract the curtain 112 into the housing. If the triggering conditions persists after a retraction is initiated, the controller can cause the curtain 112 to retract into the housing where it will again deploy due to the presence of smoke, noxious fumes, or contaminated air. The automatic retract feature can be disabled or delayed during deployment to prevent triboelectric noise or other noise from triggering a retraction of the curtain 112. In general, alternative embodiments described herein are substantially similar to previously described embodiments, and common elements and functions are identified by the same reference numbers. Only significant differences in construction or operation are described in detail.

In another alternative embodiment, the fail-safe characteristics of the barrier assembly 100 can be increased by setting the curtain 112 to deploy upon an unusual indication from the up-limit switch. If the coupler 122 slips slowly, the up-limit switch will eventually be closed. When this happens the coupler 122 can be de-energized deploying the curtain 112. The voltage across the smoke/fume-detector wires can also be monitored. If the voltage goes beyond a preset limit indicating smoke, or an open circuit in the smoke detector occurs, the screen 112 will deploy. Upon the voltage returning to the proper range, an auto-retract can occur, if enabled. If the voltage is too low, or if there is a phase or other electrical anomaly, then there could be a short or ground fault in the smoke-detector wires. In each of these cases, the screen 112 can deploy after a selected time, e.g., approximately 10–15 seconds. (The 10–15 second delay can be set to prevent a false deploy during a power outage.) Upon correction of the condition, the auto-retract can again occur, if enabled.

Figure 6:
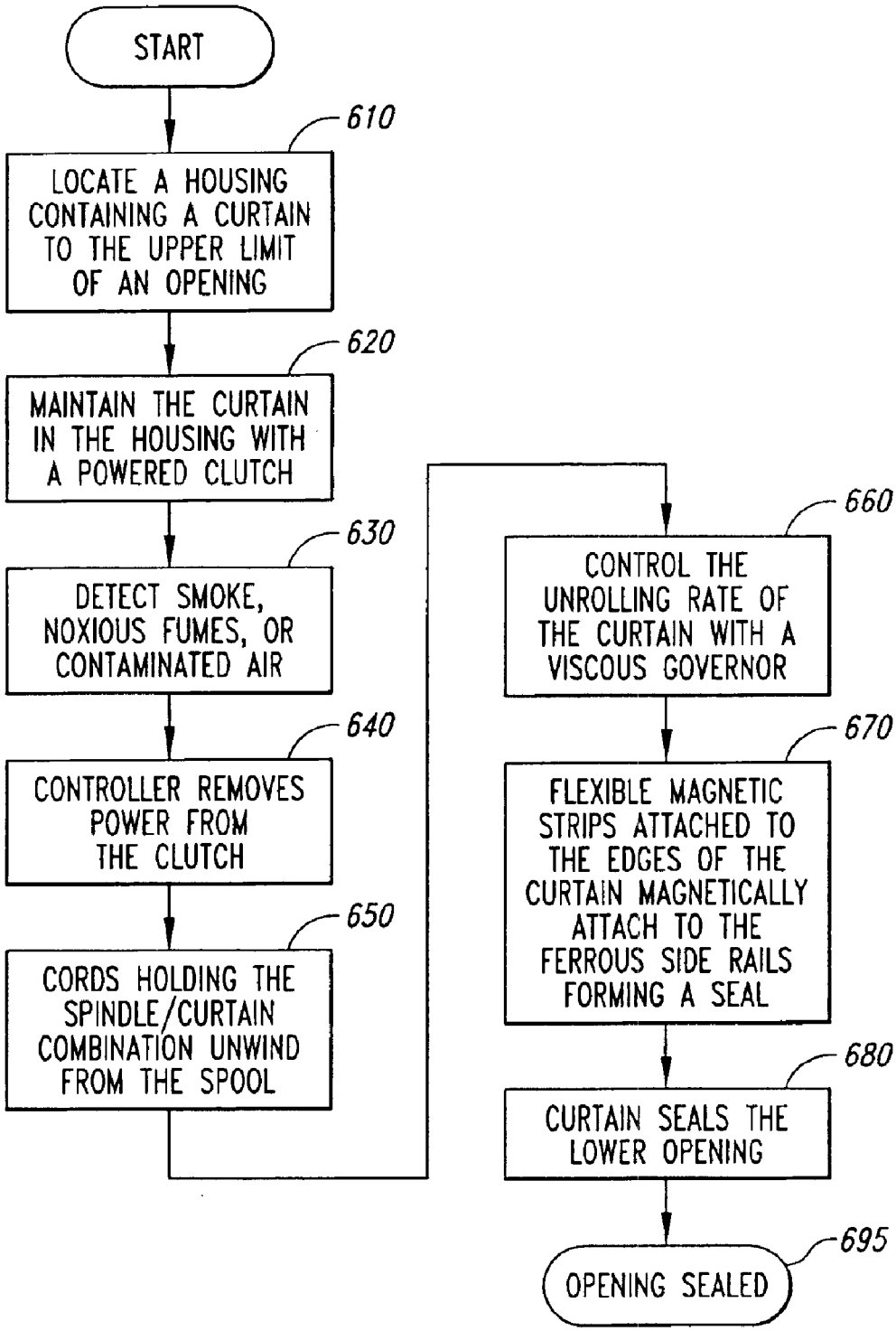
FIG. 6 is a flow chart of one embodiment of a method for sealing an opening from smoke, noxious fumes, or contaminated air.

FIG. 6 is a flow chart of one embodiment of a method for sealing an opening from noxious fumes, smoke or contaminated air. A housing 132, containing a curtain 112 wound around a spindle 142, is positioned adjacent to the upper limit of an opening 114 (at block 610). The curtain 112 is maintained in the housing 132 in a rolled-up, stored position. In one embodiment, the curtain is maintained in the stored position (at block 620) using a powered clutch or coupler 122 described herein. Upon the detection of smoke, noxious fumes or contaminated air (at block 630), the controller 130 removes power from the coupler 122 (at block 640). The power can be removed by opening a switch or similar device or upon a power failure, such that the coupler 122 disengages the spool 250 from the motor 120. With the power removed, the spool 250 or the drive shaft 502 in the alternate embodiment, is released allowing the cords 140 supporting the curtain 112 to unwind from the spool 250. As the cords 140 unwind and the curtain 112 unrolls downwardly toward the fully deployed, lower position (at block 650), the rate at which the curtain 112 and spindle 142 descends in front of the opening 114 is controlled by the viscous governor 124 (at block 660). The viscous governor 124 can be selected or configured to achieve a desired deployment speed.

Descending in front of the opening 114, the curtain 112 unrolls in such a manner so the flexible magnets strips 144 magnetically adhere to the ferrous rails 146 adjacent to the opening 114 (at block 670). Accordingly, seals are formed along the sides of the opening 114 that block the migration of smoke or other gases past the curtain 112. Upon reaching the lower limit of the opening 114, the curtain 112 and spindle 142 forms a seal (at block 680) at the lower limit of the opening 114, thereby sealing the opening 114 (at block 695) and preventing the passage of smoke, noxious fumes, or contaminated air through the opening. After the curtain 112 has been deployed, and the event or condition requiring the opening 114 to be sealed has ended, the curtain 112 and the spindle 142 are rolled back up to the stored position and retained in the housing as discussed herein.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to."

The above detailed descriptions of embodiments of the invention are not intended to be exhaustive or to limit the invention to the precise form disclosed above. In general, the terms used in the following claims should not be construed to limit the invention to the specific embodiments disclosed in the specification. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform the same function while having steps in a different order. The teachings of the invention provided herein can be applied to other systems, not necessarily the smoke and fume sealing system described previously. These and other changes can be made to the invention in light of the detailed description. Furthermore, the elements and acts of the various embodiments above can be combined to provide further embodiments beyond those described. All of the above references and U.S. patents and applications are incorporated herein by reference. Aspects of the invention can be modified, if necessary, to employ the systems, functions and concepts of the various patents and applications described above to provide yet further embodiments of the invention.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

We claim:

1. A barrier assembly for sealing off an opening having a top portion and side portions, comprising:

a housing mountably adjacent to the top portion of the opening;

a curtain assembly coupled to the housing, the curtain assembly being movable between a stored position and a deployed position, the curtain assembly in the stored position being contained in the housing, and the curtain assembly in the deployed position sealably covering the opening;

a coupler coupled to the curtain assembly and being movable between retaining position and a released position, the coupler in the retaining position configured to retain the curtain assembly in the stored position until the coupler is moved to the released position, the coupler in the released position configured to allow the curtain assembly to move toward the deployed position, the coupler operatively coupled to a power source to move to the released position in response to a power failure;

a deployment governor connected to the curtain assembly and configured to control deployment speed of the curtain assembly as the curtain assembly moves toward the deployed position; and a rewind control switch configurable to automatically cause the curtain to be moved to the stored position with a resumption of power after the power failure.

2. The assembly of claim 1 wherein the coupler is a powered clutch configured to remain in the engaged position to retain the curtain in the housing in the raised, stored position while power is applied, and wherein the powered clutch moves to the released position to release the curtain assembly when power to the clutch is interrupted.

3. The assembly of claim 2, further including an emergency power source, the emergency power source connected to the powered clutch to prevent inadvertent releases of the curtain assembly due to momentary power losses.

4. The assembly of claim 1 wherein the deployment governor limits the rate of rotation of the spool to a substantially constant rate.

5. The assembly of claim 1 wherein the coupler is a clutch.

6. The assembly of claim 1 wherein the deployment governor's resistance is directly proportional to the weight of the curtain as the curtain moves toward the deployed position.

7. The assembly of claim 1, the assembly being connectable to a primary power supply source, and further comprising an emergency power supply, and wherein the coupler is connected to the emergency power supply.

8. The assembly of claim 7, the assembly being connectable to a primary power supply source, wherein the emergency power supply provides sufficient power to the coupler when power from the primary power supply is interrupted and retains the coupler in the engaged position for a selected time period before the coupler moves to the released position.

9. The assembly of claim 7 wherein the emergency power is a capacitor capable of preventing the coupler from moving to the released position for at least approximately a ten second loss of power from the primary power source.

10. The assembly of claim 1, further comprising a motor connected to the coupler coupled to the rewind control switch and activatable to move the curtain assembly from the deployed position to the stored position, the motor being configured to provide substantially no resistance to deployment of the curtain assembly to the deployed position.

11. An apparatus for sealing off an opening having a top portion and side portions, comprising:

a housing postionably adjacent to the top portion opening;

a curtain assembly having a curtain of substantially gas impervious, material wound on a spindle, the spindle and the curtain being movable between a raised, stored position in the housing and a lowered, deployed position covering the opening;

a coupler coupled to the curtain assembly and connectable to a power source, the coupler being configured to retain the spindle in the housing in the raised, stored position while power is applied to the coupler and release the spindle allowing the spindle and curtain to move toward the lowered, deployed position unrolling the curtain across the opening;

a governor coupled to the curtain assembly and configured to control a rate of deployment of the curtain toward the lowered, deployed position;

a flexible sealing mechanism sealably engaging the side portions of the opening when the curtain is in the lowered, deployed position; and a rewind control switch configurable to automatically rewind the curtain with a resumption of power after a power failure deployment of the curtain.

12. The assembly of claim 11, wherein the flexible sealing mechanism includes a flexible magnetic strip attached to the curtain and a ferrous metal frame attached to the side portions of the opening the curtain being sized such that as the curtain unrolls from the spindle as the spindle moves toward the lower, deployed position, the flexible magnetic strip magnetically attached to the corresponding ferrous metal frame.

13. A barrier assembly for sealing off an opening having a top portion and side portions, comprising:

a housing located adjacent to the top portion of the opening;

a curtain of a substantially gas impervious material, the curtain having edge portions and being movable between a raised, stored position and a lowered, deployed position, the curtain being fully contained in the housing above the opening when in the raised, stored position, the curtain extending over and fully covering and substantially sealing the opening when in the lowered, deployed position;

a flexible sealing mechanism attached to and extending along the edge portions of the curtain, the sealing mechanism sealably engaging the side portions of the opening when the curtain is in the lowered, deployed position;

a spindle connected to the curtain with the curtain being wound around the spindle when in the raised, stored position and with the curtain winding onto and off of the spindle as the curtain moves between the raised, stored position and the lowered, deployed position, the spindle having end portions and a pulley attached to each end portion;

a cord attached to the pulley at each end of the spindle;

a drive shaft coupled to the cord and being rotatable to wind the cord around a spool and roll the curtain toward the raised, stored position and to unwind to allow the curtain to move toward the lowered, deployed position;

a powered drive coupleable to the drive shaft and rotatable to rotate the drive shaft in one rotational direction, and move the curtain toward the raised, stored position and to hold the curtain in the raised, stored position;

a coupler connected to the drive shaft, the coupler being movable between an engaged position and a released position and configured to couple the drive shaft to the powered drive when in the engaged position and to uncouple the drive shaft from the powered drive when in the released position allowing the curtain to unroll toward the lowered, deployed position;

a deployment governor connected to the drive shaft and positioned to limit a speed at which the drive shaft rotates when the curtain unrolls and moves toward the lowered, deployed position, thereby controlling the rate of deployment of the curtain over the opening.

14. A barrier assembly for sealing off an opening having a top portion and side portions, comprising:

a housing located adjacent to the top portion of the opening;

a curtain of a substantially gas impervious material, the curtain having edge portions and being movable between a raised, stored position and a lowered, deployed position, the curtain being fully contained in the housing above the opening when in the raised, stored position, the curtain extending over and fully covering and substantially sealing the opening when in the lowered, deployed position;

a spindle connected to the curtain with the curtain being wound around the spindle when in the raised, stored position and with the curtain winding onto and off of the spindle as the curtain moves between the raised, stored position and the lowered, deployed position, the spindle having end portions and a pulley attached to each end portion;

a cord attached to the pulley at each end of the spindle;

a drive shaft coupled to the cord and being rotatable to wind the cord around a spool and roll the curtain toward the raised, stored position and to unwind from the spool to allow the curtain to move toward the lowered, deployed position;

a powered drive coupleable to the spool or drive shaft and rotatable to rotate the spool in one rotational direction, and wind the cord onto the spool, rewind the curtain onto the spindle, and move the curtain toward the raised, stored position and to hold the curtain in the raised, stored position;

a coupler connected to the spool, the coupler being movable between an engaged position and a released position and configured to couple the spool to the powered drive when in the engaged position and to uncouple the spool from the powered drive when in the released position allowing the curtain to unroll toward the lowered, deployed position;

a deployment governor connected to the spool and positioned to limit a speed at which the spool rotates when the curtain unrolls and moves toward the lowered, deployed position, thereby controlling the rate of deployment of the curtain over the opening; and a rewind control that stops the powered drive to limit the upward movement of the spindle and rewinding of the curtain.

* * * * *

UNITED STATES PATENT AND TRADEMARK OFFICE

CERTIFICATE OF CORRECTION

PATENT NO. : 7,000,668 B2
DATED : February 21, 2006
INVENTOR(S) : John J. Sears et al.

It is certified that error appears in the above-identified patent and that said Letters Patent is hereby corrected as shown below:

Column 3,
Line 5, "50" should be -- so --;

Column 4,
Line 17, "functionally" should be -- functionality --.

Signed and Sealed this

Ninth Day of May, 2006

JON W. DUDAS
*Director of the United States Patent and Trademark Office*